United States Patent [19]

Anderson

[11] 4,119,239

[45] Oct. 10, 1978

[54] CONTAINER LOCK DEVICE

[75] Inventor: Howard A. Anderson, Pittsburgh, Pa.

[73] Assignee: Cities Service Company, Tulsa, Okla.

[21] Appl. No.: 857,639

[22] Filed: Dec. 5, 1977

Related U.S. Application Data

[63] Continuation of Ser. No. 689,430, May 24, 1976, abandoned.

[51] Int. Cl.[2] ..... B65D 45/16

[52] U.S. Cl. ..... 220/324; 220/284; 220/306; 220/355

[58] Field of Search ..... 220/324, 284, 306, 320, 220/355

[56] References Cited

U.S. PATENT DOCUMENTS

| | | | |
|---|---|---|---|
| 1,482,931 | 2/1924 | Keehn | 220/324 |
| 1,502,673 | 7/1924 | Hole | 220/324 |
| 2,024,493 | 12/1935 | Weinrich | 220/324 |
| 2,551,499 | 5/1951 | Maitland | 220/324 |
| 2,760,674 | 8/1956 | Karp | 220/324 |
| 2,935,108 | 5/1960 | Hall | 220/324 |
| 3,360,644 | 12/1967 | Lillebostad | 220/324 |
| 3,420,399 | 1/1969 | Heisler | 220/324 |
| 3,785,418 | 1/1974 | Henning | 150/52 R |
| 3,811,597 | 5/1974 | Frankenberg | 220/284 |
| 3,868,041 | 2/1975 | Knize | 220/324 |

*Primary Examiner*—Ro E. Hart

*Attorney, Agent, or Firm*—Donald L. Traut

[57] ABSTRACT

A container including a closure having an automatic closure lock device which is manually releasable.

7 Claims, 4 Drawing Figures

CONTAINER LOCK DEVICE

This is a continuation of application Ser. No. 689,430, filed May 24, 1976 now abandoned.

BACKGROUND OF THE INVENTION

The present invention relates to containers having a box or drum-like structure fabricated from plastic or metallic material including a container closure fitted with a lock device which locks the closure of the container automatically when the closure is positioned upon the container. The closure is unlocked manually.

The lock device is useful repetitively and is not rendered inoperative upon a single use as is the case with certain prior art devices.

PRIOR ART

Typical prior art containers of the class within which the present invention falls are disclosed and described in U.S. Pat. Nos. 952,827 to Martin, 1,593,633 to Johnson and 3,811,597 to Frankenberg et al.

Martin discloses a manually operable lifter useful to remove a metallic closure which has been crimped or deformed to fit tightly and seal the mouth or opening of a bottle or a jar.

Johnson discloses a typical 5 gallon "paint" bucket closure which is crimped to the bucket by a plurality of deformable tabs which cooperate with a mating bead or lip on the upper periphery of the bucket. The tabs are disposed at spaced intervals along the lip and the closure is removed by prying and bending the tabs away from the bucket lip sequentially until all tabs are free and the closure is thereafter lifted away from the bucket.

The most pertinent prior art is Frankenberg et al. which discloses a plastic container and closure having a double lock feature all of whose elements are molded integrally of plastic with either the closure or the container.

The first lock is effective to make a liquid or a product tight seal and is unlocked by the use of a rather substantial pry bar in the form of a metal rod.

The first lock is permanently distorted and deformed upon opening and is thus useful only once. The second lock, a friction lock, is available repetitively merely to keep the closure in place and has no sealing capability as would be necessary during shipment in Interstate Commerce.

SUMMARY OF THE INVENTION

In contrast to the above prior art, the present invention contemplates a container having a separable closure where the closure is fitted with a separably fabricated lock device that cooperates with the container when in the closed condition to lock the closure and the container together automatically.

A feature of the invention is the provision of a lock device which is useful repetitively.

A further feature of the invention is the provision of a lock device which is manually releasable with light finger pressure.

A further feature of the invention is the provision of a lock device that is protected, by virtue of its location, from weather damage or other accidental destruction.

A still further feature of the invention is the provision of a lock device that will not open accidentally as frequently occurs in the case of prior art locks when a container is upset by wind or animals.

A container lock device embracing certain features of the present invention may comprise, in combination, a container having a sidewall terminating in a lip, a cooperating container closure and at least one locking spring clip, said clip defining a strip of resilient material having a pair of spaced, generally parallel legs, said legs being operable to straddle said sidewall and said lip, one leg of said pair being formed with a shoulder operable to make a locking connection with said lip, said legs being spring biased toward one another so that said one leg of the clip is movable from a first or normal position in which said shoulder makes a locking connection with said lip to a second position in which said shoulder is free of said lip without exceeding the elastic limit of said clip.

BRIEF DESCRIPTION OF THE INVENTION

Other features and advantages of the present invention will become more apparent from an examination of the following specification when read in conjunction with the appended drawings, in which.

DETAILED DESCRIPTION OF THE INVENTION

Figure 1:
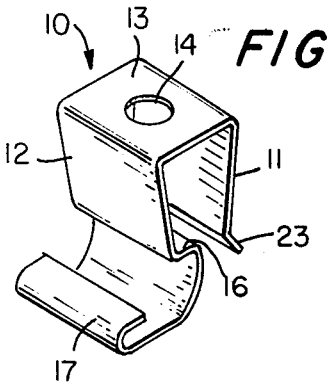
FIG. 1 is a perspective view of a typical spring clip forming a feature of the present invention.

Referring now in detail to the drawings, the reference numeral 10 designates a locking spring clip fabricated of metallic or other suitable material having a pair of generally parallel legs 11 and 12 joined by a saddle or strap 13 formed with a fastener aperture 14.

The leg 12 is formed with a shoulder or offset 16 terminating in a return bend portion identified by the reference numeral 17.

Figure 2:
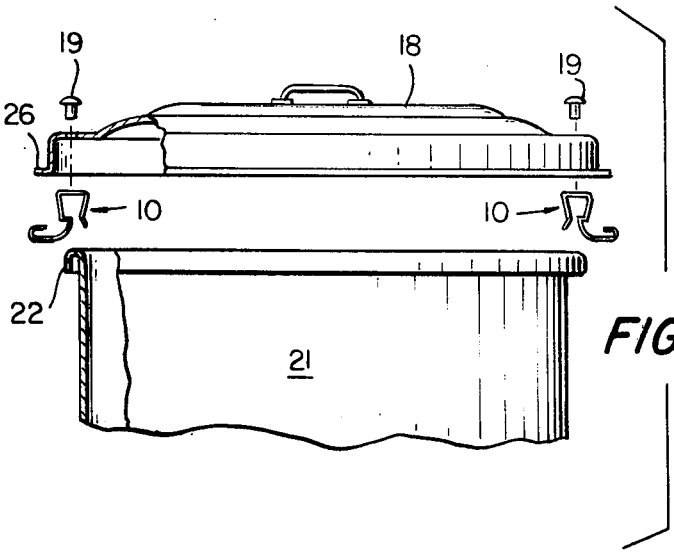
FIG. 2 is an exploded view, partially broken away, showing disposition of spring clips relative to the container closure.

As is apparent in FIG. 2 the clip 10 is fastened to the underside of closure 18 by means of a rivet or other similar fastener 19.

Although one clip 10 is satisfactory, in the interest of symmetry and additional insurance, it is preferred that two clips 10—10 be utilized and disposed oppositely approximately 180° apart.

Where a single clip is used it is frequently desirable to utilize a separable hinge or hook arrangement opposite the clip (180° from the clip) to insure that the closure remains in place when placed upon the container.

Figure 3:
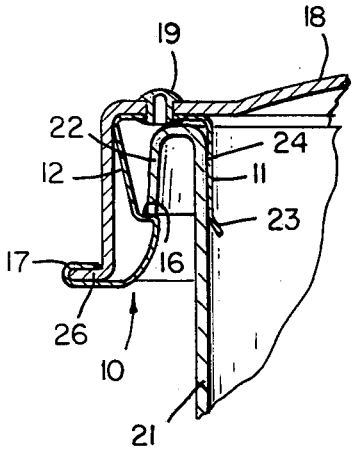
FIG. 3 is a sectional view of a portion of a container and its closure with the lock device in the locking or normal position; and, FIG. 4 is a view similar to the illustration of FIG. 3 disclosing the spring clip in the second or unlocked position.

FIG. 3 shows the lock device in the first or normal position wherein closure 18 is in place upon container 21 and clip 10 is secured to the underside of the closure 18 by rivet 19 providing a positive lock.

Leg 11 is biased toward leg 12 (or vice versa) so that shoulder 16 of leg 12 underlays and makes good contact with lip 22 of the container.

Correspondingly, leg 11, flared as at 23 to facilitate entry upon the container, makes good contact with the container sidewall as at 24.

Note that return bend portion 17 makes a reasonably snug fit with mating rim 26.

Figure 4:
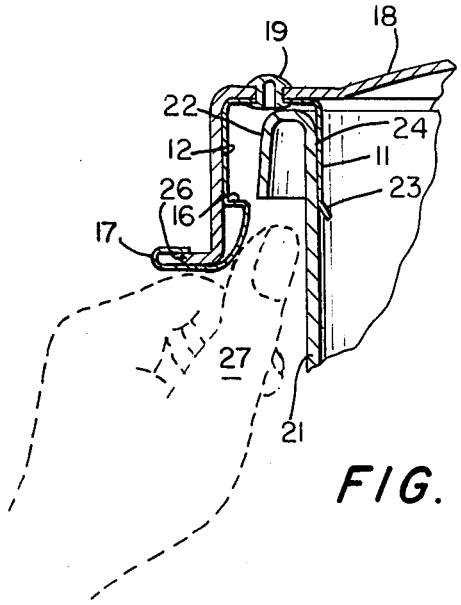

FIG. 4 shows the lock device in the second or unlocked position.

The reference numeral 27 is intended to designate the fingers of an operator who with light finger pressure is able to move leg 12 to the left, as viewed in FIG. 4 against the interior of the closure 18 with the result that shoulder 16 is rotated free of rim 22 of container 21 thus unlocking the closure and freeing it for upward movement clear of the container.

Naturally when the leg 12 is released, the clip automatically springs back to its normal or first position and is in condition to operate automatically to lock the closure 18 to the container 21 when the closure is next placed upon the container and pressed downwardly.

The sidewall 15 of the closure 18 limits the stroke of the leg 12 of the clip 10, as is most apparent in FIG. 4, to provide flexure control, thereby insuring that the elastic limit of the material from which clip 10 is fabricated is not exceeded.

Obviously one or more clip devices 10 may be utilized and disposed about the underside of the closure as desired.

It is anticipated that a wide variety of modifications and design changes can be developed without departing from the spirit of the scope of the invention.

What is claimed is:

1. In combination, a container having a sidewall terminating in a lip, a cooperating container closure having a sidewall and at least one locking spring clip, said clip defining a strip of resilient material having a pair of spaced, generally paralled legs, and said legs being operable to straddle said sidewall and said lip, one leg of said pair being formed with a shoulder operable to make a locking connection with said lip, said legs being spring biased toward one another so that said one leg of the clip is movable from a first or normal position in which said shoulder makes a locking connection with said lip to a second position in which said shoulder is free of said lip and abutts said closure sidewall operative to limit the stroke of said one leg to avoid without exceeding the elastic limit of said clip.

2. The combination of claim 1 in which the clip is secured to the closure.

3. The combination of claim 1 in which a plurality of clips cooperate with a given container and its closure to effect a plurality of locking connections between a container and its closures.

4. A combination of claim 1 in which the locking spring clip is fabricated of spring steel.

5. The combination of claim 1 in which the clip is fabricated of a resilient plastic material.

6. The combination of claim 1 in which the clip is riveted to the closure.

7. A clip device for securing a closure to a container where the container is formed with a sidewall terminating in a rim or lip comprising a resilient strip of deformable material having a pair of spaced, generally parallel legs, said legs being joined by a saddle portion and being resiliantly biased so as to resist separation, one leg of said pair being formed with a locking shoulder normally operable to make a locking connection with said rim, said leg being movable with a limited stroke against said bias to a second position to break said locking connection.

* * * * *